US007574773B2

(12) United States Patent
Dahl et al.

(10) Patent No.: US 7,574,773 B2
(45) Date of Patent: Aug. 18, 2009

(54) HINGE CONSTRUCTION AND PROTECTIVE DEVICE HAVING A HINGE CONSTRUCTION

(75) Inventors: Joerg-Uwe Dahl, Werder (DE); Ludvik Godesa, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 349 days.

(21) Appl. No.: 11/219,860

(22) Filed: Sep. 7, 2005

(65) Prior Publication Data

US 2006/0048336 A1 Mar. 9, 2006

(30) Foreign Application Priority Data

Sep. 8, 2004 (DE) ..... 10 2004 044 672

(51) Int. Cl.
*E05D 7/12* (2006.01)

(52) U.S. Cl. ..... 16/258; 16/259; 16/269; 16/231; 220/841; 220/3.8; 220/324

(58) Field of Classification Search ..... 16/258, 16/269, 259, 267, 268, 356, 266, 355, 231, 16/260; 220/841, 3.8, 324; 49/397, 402
See application file for complete search history.

(56) References Cited

U.S. PATENT DOCUMENTS

| | | | | |
|---|---|---|---|---|
| 2,968,829 | A | 1/1961 | Meddick | |
| 4,232,890 | A * | 11/1980 | Hoen | 292/114 |
| 4,270,668 | A * | 6/1981 | Berfield | 220/324 |
| 4,635,396 | A * | 1/1987 | Ranz et al. | 49/141 |
| 5,075,927 | A * | 12/1991 | Porta | 16/273 |
| 5,125,697 | A * | 6/1992 | Kahl et al. | 292/204 |
| 5,150,500 | A | 9/1992 | Bisbing | |
| 5,255,965 | A * | 10/1993 | Chen et al. | 312/7.1 |
| 5,472,110 | A * | 12/1995 | Boyd et al. | 220/326 |
| 5,809,617 | A | 9/1998 | Harris et al. | |
| 7,090,089 | B2 * | 8/2006 | Lown et al. | 220/324 |
| 2004/0178202 | A1 * | 9/2004 | Serio, Jr. | 220/324 |

FOREIGN PATENT DOCUMENTS

DE 42 19 681 A1 1/1993

OTHER PUBLICATIONS

Siemems, Sentron WL, 23-1-23-3, Apr. 2004.
Southco Hinges, pp. 304-305, 2003, http://www.southco.com/resources/documents/f6.en.pdf.

* cited by examiner

*Primary Examiner*—Victor Batson
*Assistant Examiner*—Jeffrey O'Brien
(74) *Attorney, Agent, or Firm*—Harness, Dickey & Pierce

(57) ABSTRACT

A hinge construction is for connecting two components. The hinge construction includes a first securing part which can be fixed on a first of the two components, a second securing part which can be fixed on the second component, and a hinge part. The hinge construction further includes a first coupling device for the rotatable coupling of the first securing part to the hinge part, and a second coupling device for the pivotable coupling of the hinge part to the second securing part. The second coupling device, in order to set a distance between the two components, includes two corresponding, curved coupling surfaces, which run parallel to the pivot axis and of which a first is provided on the hinge part and the second is provided on the second securing part.

20 Claims, 4 Drawing Sheets

HINGE CONSTRUCTION AND PROTECTIVE DEVICE HAVING A HINGE CONSTRUCTION

The present application hereby claims priority under 35 U.S.C. §119 on German patent application number DE 10 2004 044 672.5 filed Sep. 8, 2004, the entire contents of which is hereby incorporated herein by reference.

FIELD

The invention is generally based on the field of hinges and generally relates to a hinge construction for connecting two components.

BACKGROUND

In the case of a known hinge construction, having a first securing part which can be fixed on a first of the two components, having a second securing part which can be fixed on the second component, having a hinge part, having a first coupling device for the rotatable coupling of the first securing part to the hinge part, and having a second coupling device for the pivotable coupling of the hinge part to the second securing part, the second coupling device, in order to set a predetermined distance between the two components, includes two corresponding, curved coupling surfaces, which run parallel to the pivot axis and of which a first is provided on the hinge part and the second is provided on the second securing part (DE 42 19 681 A1).

In the case of this known hinge construction, the two coupling surfaces are designed in such a manner that they bear against each other along an effective section of their coupling surfaces, which section extends parallel to an extensive connecting gap between the two components. The width of the connecting gap can be changed by pivoting the hinge part in relation to the second securing part. Provision is made in this case, after a desired width of the connecting gap is set, to firmly fix the hinge part and the second securing part on each other via a screw connection.

SUMMARY

At least one embodiment of the invention includes an object of simplifying the structural configuration of the hinge construction.

An object may be achieved according to at least one embodiment of the invention by the fact that at least one section of at least one of the two coupling surfaces is eccentric in the pivoting direction.

In the case of such a configuration, the coupling surfaces bear against each other at least along an effective coupling line which runs parallel to the connecting gap, with the position of the effective coupling line being displaced by the hinge part being pivoted in relation to the second securing part while changing the width of the connecting gap.

One example configuration of the novel hinge construction makes provision for the hinge part to be provided with an actuating arm for pivoting the hinge part, this actuating arm preferably being designed as a handle. Such a configuration not only facilitates the pivoting of the hinge part in relation to the second securing part and therefore the setting of the width of the connecting gap, but rather also the initial coupling of both coupling surfaces of the hinge part and of the second securing part.

Further advantageous configurations of the novel hinge construction make provision for the first securing part and the hinge part to be designed in a manner such that they can be decoupled perpendicularly to the axis of rotation and for the hinge part and the second securing part to be designed such that they can be decoupled perpendicularly to the rotationary axis. This has the advantage of simple exchangeability of the hinge part.

It is advantageous if, in order to fix a predetermined width of the connecting gap, the hinge part can be fixed on the first securing part counter to an elastic force in at least one rotational position in relation to the first securing part. For this purpose, one example embodiment makes provision for the first securing part to have a latching cam and the hinge part to have a latching pin interacting with the latching cam.

The novel hinge construction can be used for example, in the case of protective devices which are intended for protecting electrical apparatus and which have a first component designed as a frame, a second component designed as a covering, and a hinge construction for fastening the covering to the frame. Protective devices of this type may be subject to different protective systems of the standard DIN VDE 0470-1. For example, the protective system IP 55 requires that the protective device ensures protection against harmful accumulations of dust and protection against a jet of water from a nozzle.

For example, it is customary, in switchgear cabinets or switchgear assemblies, to close cutouts in the door (frame), through which the operating console of a power switch protrudes, by transparent coverings in order to protect the switchgear assembly or the switchgear cabinet against the penetration of dust and spray water.

It is particularly important here, despite the large dimensions and the associated large deviations in the flatness of the components, to ensure a good sealing action between door (frame) and covering and at the same time to ensure simple handling of the covering—in particular a simple fitting of the covering on the frame and a simple opening of the covering.

One example embodiment of the novel protective device therefore provides an elastic seal between the covering and the frame. In this case, the sealing action is produced during the closing movement of the hinge construction. Large sealing distances (deformations of the elastic seal) can thus be realized without making the handling more difficult.

BRIEF DESCRIPTION OF THE DRAWINGS

An example embodiment of a protective device according to at least one embodiment of the invention having two hinge constructions is illustrated in FIGS. 4 to 11.

In the drawings:

FIG. 1 shows a protective device which is already known in practical experience and has a frame of a covering and two hinge constructions;

FIG. 2 shows a sectional illustration of the protective device according to FIG. 1 on line A-A;

FIG. 3 shows an enlarged detail from FIG. 2;

DETAILED DESCRIPTION OF THE EXAMPLE EMBODIMENTS

Figure 1:
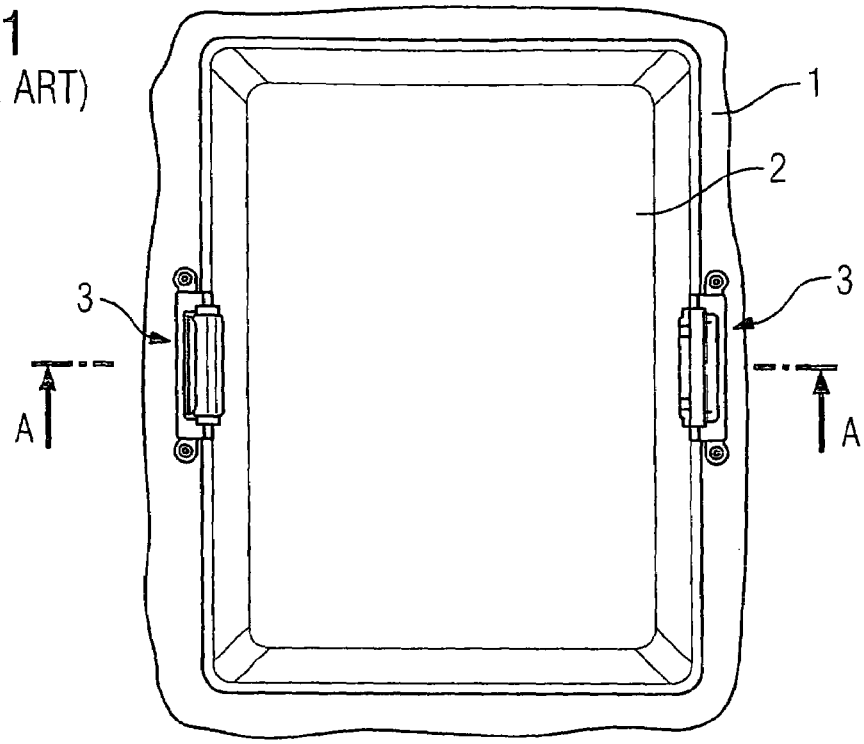
FIG 1 (PRIOR ART)
FIGS. 1 to 3 show a protective device (already known from practical experience) for electrical apparatus accommodated in switchgear assemblies.
Figure 2:
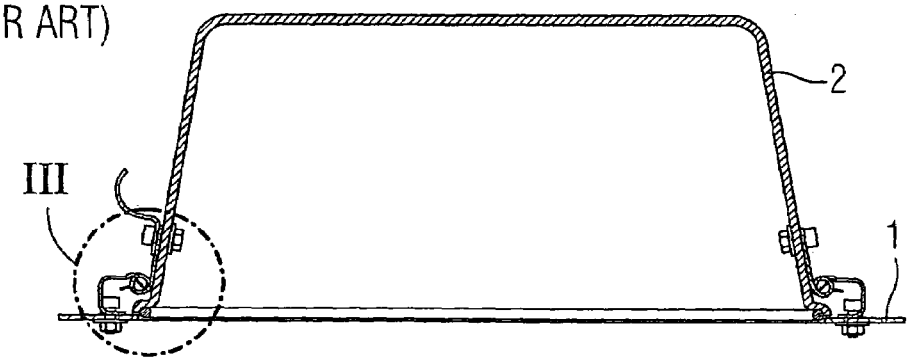
FIG 2 (PRIOR ART)
Figure 3:
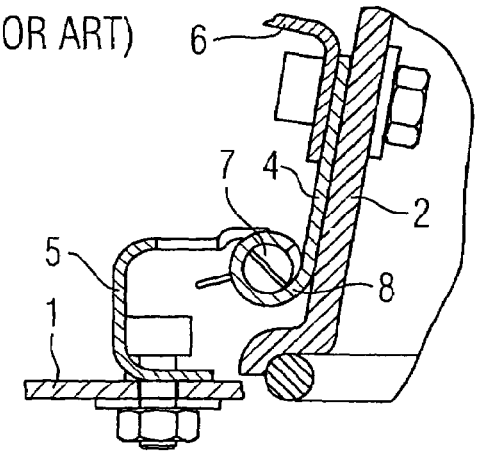
FIG 3 (PRIOR ART)

Protective devices as shown in FIGS. 1 to 3, which have a frame 1, a covering 2 and two hinge constructions 3, with the hinge constructions 3 being designed in such a manner that on both sides they permit both a pivoting of the covering 2 in relation to the frame 1 and a raising of the covering 2 from the frame 1, are already known in practical experience (hinge construction from Southco, INC. US,). According to FIG. 3, the known hinge construction 3 has a first securing part 4 and a second securing part 5 which are connected rotatable to each other via a coupling device and of which the first 4 is fastened to the covering 2 and the second 5 is fastened to the frame 1. In addition, the hinge construction 3 in practical experience has a handle 6 in order to facilitate, during the placing of the covering 2 onto the frame 1, an insertion of an axially displaceable bolt 7 provided on the first securing part 4 into a sleeve 8 provided on the second securing part.

Figure 4:
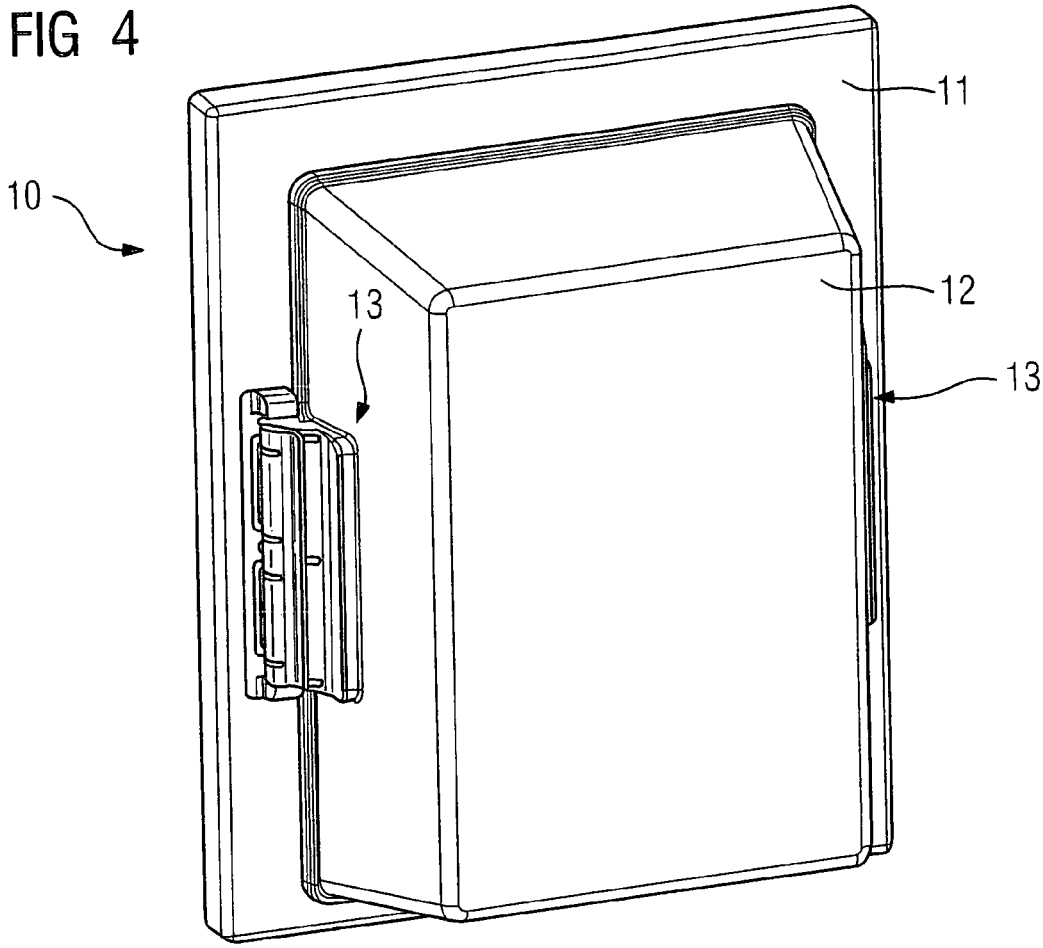
FIG. 4 shows a protective device according to an embodiment of the invention having a frame, a covering and two hinge constructions according to an embodiment of the invention.

According to FIG. 4, the novel protective device 10 likewise has a first component in the form of a covering 12, a second component in the form of a frame 11 and two hinge constructions 13 for connecting the two components, with each of the two hinge constructions 13 according to FIGS. 5 to 11 having, however, a hinge part 16 in addition to a first securing part 14 and a second securing part 15.

Figure 5:
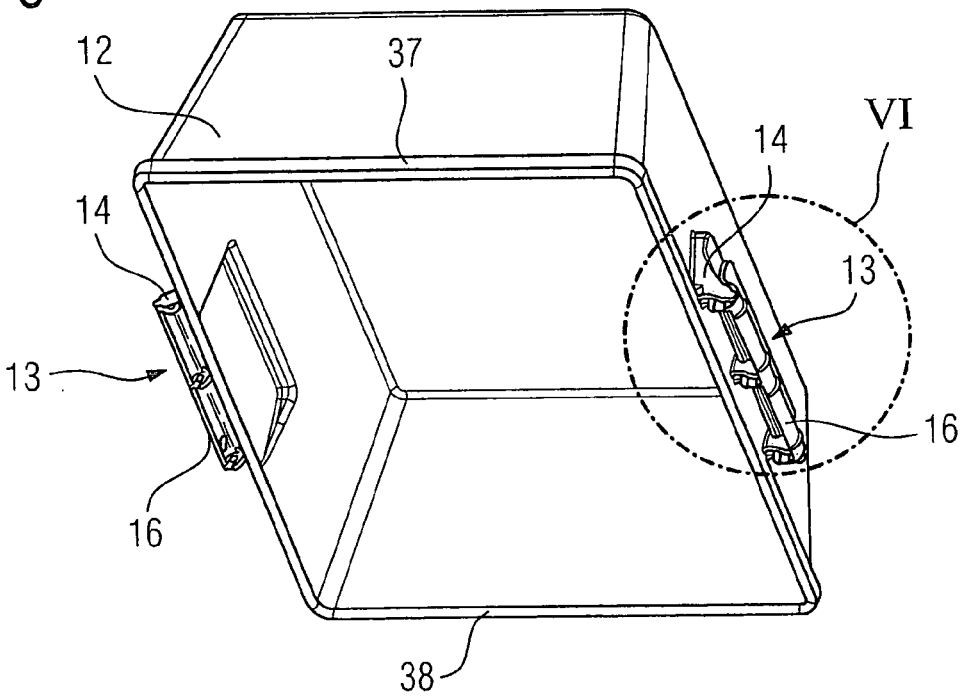
FIG. 5 shows the covering according to FIG. 4.
Figure 6:
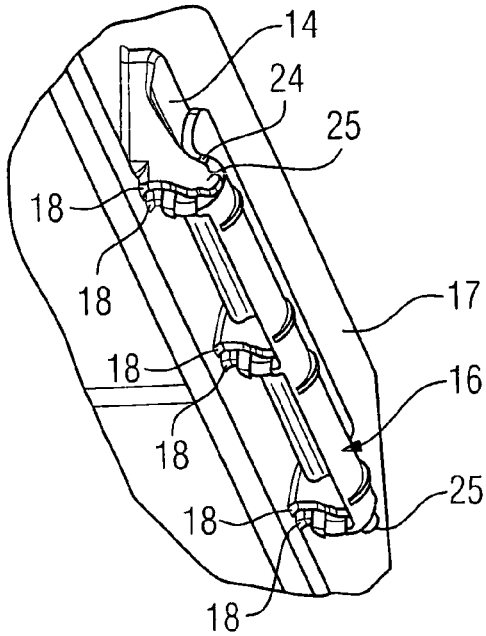
FIG. 6 shows a part of a hinge construction according to an embodiment of the invention as shown in FIG. 4, with a first securing part and a hinge part.

According to FIG. 5, the first securing part 14 is an integral part of the covering 12, which is preferably manufactured from transparent plastic. According to FIG. 6, this first securing part 14 has three pairs of supporting arms 18 protruding essentially transversely to an outer side 17 of the covering 12, each of the pairs being connected to one another via a transverse pin (not visible), which is used as an axis of rotation 19 (cf. FIG. 9) for the hinge part 16.

Figure 7:
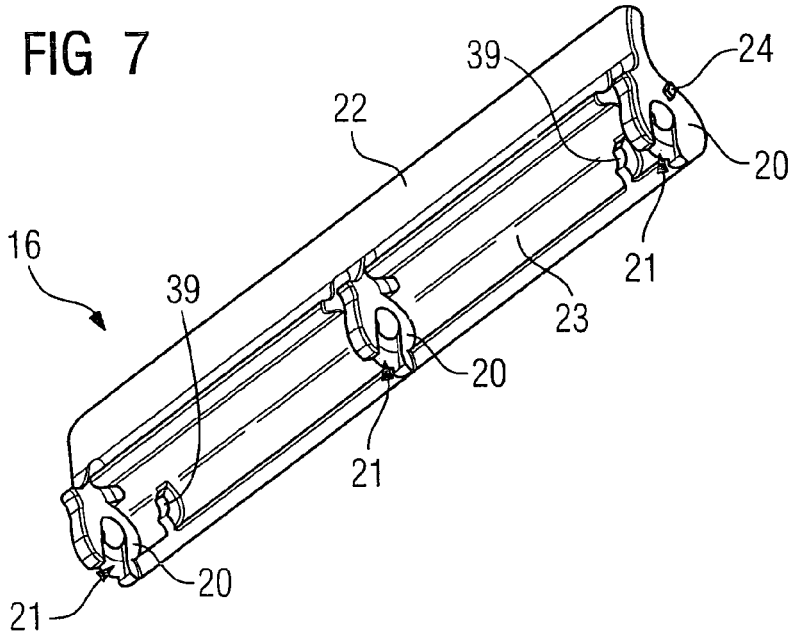
FIG. 7 shows the hinge part as shown in FIG. 6.

According to FIG. 7, the hinge part 16 has three bearing arms 20 which are suitable for the engagement between the supporting arms 18 and are provided with an elongate hole 21, which is open on one side, for engaging over the transverse pins of the securing part 14. Furthermore, the hinge part 16 has an actuating lever, which protrudes essentially radially to the axis of rotation and is the form of a handle 22, and a curved, first coupling surface 23 assigned to the second securing part 15. A latching cam 25 is provided on at least one of the supporting arms 18 of the first securing part 14 and corresponds with a latching pin 24 formed on the hinge part 16 (cf. FIG. 6).

Figure 8:
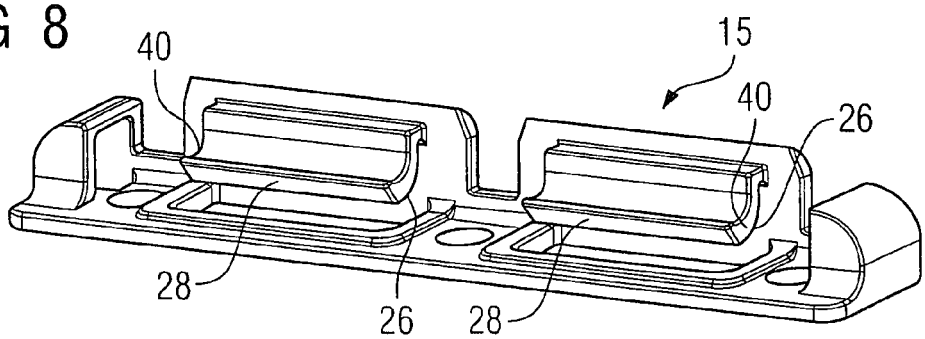
FIG. 8 shows the second securing part of the hinge construction according to an embodiment of the invention as shown in FIG. 4.

According to FIG. 8, the second securing part 15 has a two part, curved, second coupling surface 26 which is assigned to the curved, first coupling surface 23 of the hinge part 16. The curved, second coupling surface 26 of the second securing part 15 has an eccentrically formed section 28 in the pivoting direction 27 of the hinge part 16 (cf. FIG. 11).

According to FIGS. 9 to 13, the covering 12 is coupled to the frame as follows.

Figure 9:
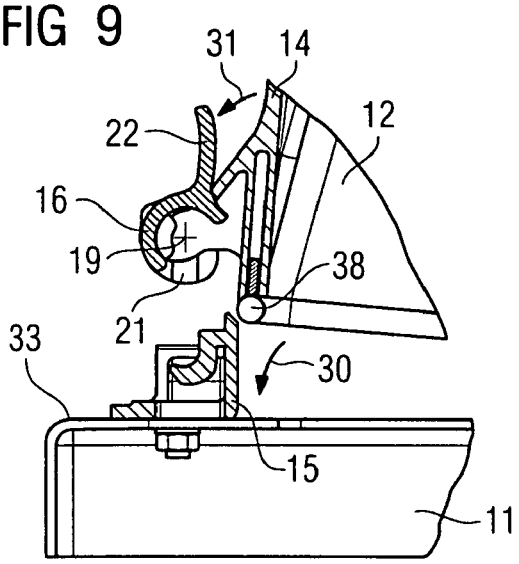
FIGS. 9 to 13 show the hinge construction in a sectional illustration at various stages of movement.
Figure 10:
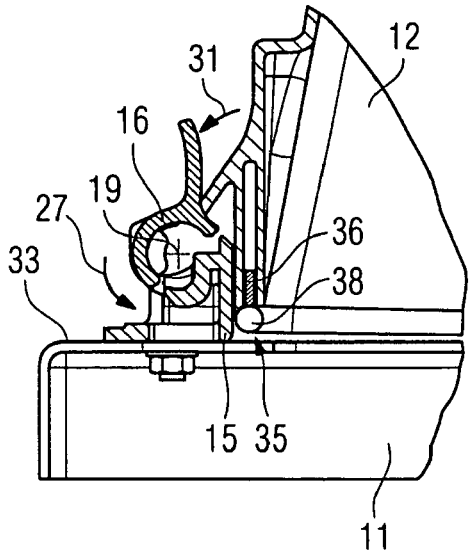
Figure 11:
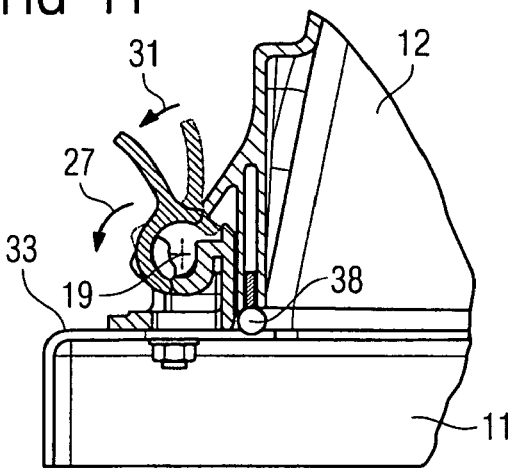
Figure 12:
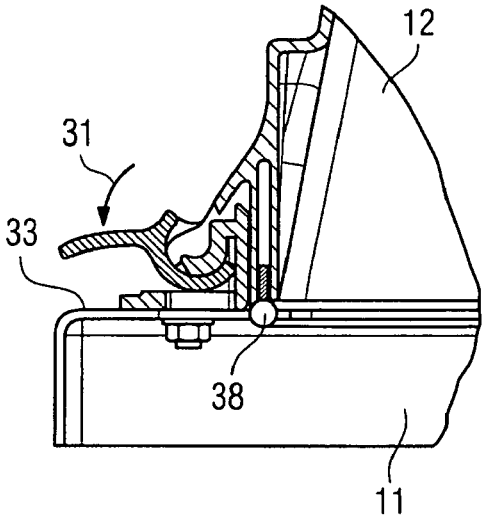

According to FIG. 9, the hinge part 16 is first of all placed onto the first securing part 14 perpendicularly to the transverse pins and therefore perpendicularly to the axis of rotation 19 by the open elongate holes 21 engaging over the transverse pins. The covering 12 is then moved in the direction 30 of the frame 11 until the hinge part 16 is opposite the second securing part 15. A manual application of force on the handle 22 in direction 31 causes the hinge part 16 to pivot in relation to the second securing part 15 in such a manner that the two coupling surfaces 23 and 26 come into engagement.

By way of the eccentric configuration of the section 28 of the second coupling surface 26, during the pivoting the distance of the respectively effective section of the two coupling surfaces 23, 26 from the side 33 of the frame 11, which side faces the covering 12, is reduced. The width of the connecting gap 35 between the covering 12 and the frame 11 is therefore reduced. A profile seal 38 inserted into a groove 36 of the periphery edge 37 of the covering 12 is compressed by the lowering of the covering 12 during closure of the hinge construction 13 and thereby ensures a sealed finish between covering and frame along the entire peripheral edge 37 of the covering 12.

The hinge part 16 is secured in an end position—i.e. in a predetermined rotational position in relation to the first securing part 14 (cf. FIG. 12) by the latching pin 25 bearing against the latching cam 24 under the elastic force of the profile seal 38.

In order to axially position the hinge part 16 in relation to the the second securing part 15, use is additionally made of webs 39, which are formed on the hinge part and interact with side surfaces 40 of the second coupling surface 26.

Figure 13:
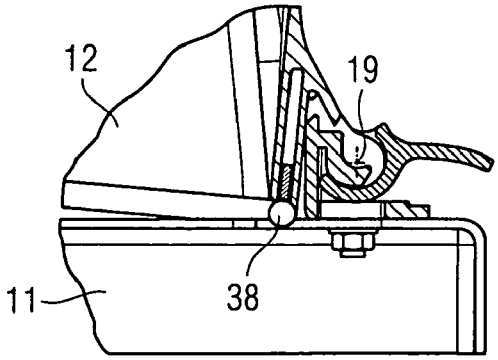

According to FIG. 13, the covering 12 can be pivoted together with the hinge part 16, which is latched in its end position on the first securing part 14, about the axis of rotation 19, since the axis of rotation 19 coincides with the pivot axis of the hinge part in the latched end position (shown in FIGS. 12 and 13) of the hinge part on the first securing part 14.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A hinge construction for connecting two components, comprising:

a first securing part, fixable on a first of the two components;

a second securing part, fixable on the second component;

a hinge part;

a first coupling device for rotatable coupling of the first securing part to the hinge part; and a second coupling device for pivotable coupling of the hinge part to the second securing part, the second coupling device, in order to set a distance between the two components, including two corresponding curved coupling surfaces which run parallel to the pivot axis and of which a first is provided on the hinge part and the second is provided on the second securing part, at least one section of at least one of the two coupling surfaces being eccentric in the pivoting direction, wherein the distance functions as a connecting gap between a circumferential edge of the first component and a side of the second component, and wherein a groove is provided in the circumferential edge, into which an elastic seal in the form of a profile seal is inserted, which is compressible during the closing of the hinge construction, wherein one of the coupling surfaces defines a concave arcuate surface defining an axis and the concave arcuate surface axis and the pivot axis are substantially colocated.

2. The hinge construction as claimed in claim 1, wherein the hinge part is provided with an actuating arm for pivoting the hinge part.

3. The hinge construction as claimed in claim 2, wherein the actuating arm is designed as a handle.

4. The hinge construction as claimed in claim 1, wherein the first securing part and the hinge part are decoupleable perpendicularly to the axis of rotation.

5. The hinge construction as claimed in claim 1, wherein the hinge part and the second securing part are decoupleable perpendicularly to the pivot axis.

6. The hinge construction as claimed in claim 1, wherein the hinge part is fixable on the first securing part counter to an elastic force in at least one rotational position.

7. The hinge construction as claimed in claim 6, wherein the first securing part has at least one latching cam and the hinge part has a latching pin interacting with the at least one latching cam.

8. A protective device, comprising:

a first component designed as a covering;

a second component designed as a frame; and at least one hinge construction for fastening the covering to the frame, the hinge construction being designed as claimed in claim 1.

9. The protective device as claimed in claim 8, wherein the first securing part is an integral part of the covering.

10. The hinge construction as claimed in claim 2, wherein the first securing part and the hinge part are decoupleable perpendicularly to the axis of rotation.

11. The hinge construction as claimed in claim 2, wherein the hinge part and the second securing part are decoupleable perpendicularly to the pivot axis.

12. The hinge construction as claimed in claim 3, wherein the first securing part and the hinge part are decoupleable perpendicularly to the axis of rotation.

13. The hinge construction as claimed in claim 3, wherein the hinge part and the second securing part are decoupleable perpendicularly to the pivot axis.

14. The hinge construction as claimed in claim 2, wherein the hinge part is fixable on the first securing part counter to an elastic force in at least one rotational position.

15. The hinge construction as claimed in claim 14, wherein the first securing part has at least one latching cam and the hinge part has a latching pin interacting with the at least one latching cam.

16. The protective device as claimed in claim 8, wherein the protective device is for protecting an electrical apparatus.

17. A hinge construction for connecting two components, comprising:

a first securing part, fixable on a first of the two components;

a second securing part, fixable on the second component;

a hinge part;

first means for rotatable coupling of the first securing part to the hinge part; and second means for pivotable coupling of the hinge part to the second securing part, the second means including two corresponding curved coupling surfaces which run parallel to the pivot axis and of which a first is provided on the hinge part and the second is provided on the second securing part, at least one section of at least one of the two coupling surfaces being eccentric in the pivoting direction, wherein the distance functions as a connecting gap between a circumferential edge of the first component and a side of the second component, and wherein a groove is provided in the circumferential edge, into which an elastic seal in the form of a profile seal is inserted, which is compressible during the closing of the hinge construction, wherein one of the coupling surfaces defines a concave arcuate surface defining an axis and the concave arcuate surface axis and the pivot axis are substantially colocated.

18. The hinge construction as claimed in claim 1, wherein the hinge part is provided with an actuating arm for pivoting the hinge part.

19. The hinge construction as claimed in claim 1, wherein as one of the coupling surfaces pivots on the other coupling surface the two components move closer to each other.

20. The hinge construction as claimed in claim 17, wherein as one of the coupling surfaces pivots on the other coupling surface the two components move closer to each other.

* * * * *